United States Patent [19]

Kawaguchi et al.

[11] Patent Number: 4,490,462

[45] Date of Patent: Dec. 25, 1984

[54] LIGHT-SENSITIVE SILVER HALIDE PHOTOGRAPHIC MATERIAL

[75] Inventors: Yasushi Kawaguchi; Kiyomitsu Mine; Keiko Ide; Yukie Yamashita; Soichiro Irie; Yotaro Hirao, all of Hino, Japan

[73] Assignee: Konishiroku Photo Industry Co., Ltd., Tokyo, Japan

[21] Appl. No.: 477,130

[22] Filed: Mar. 21, 1983

[30] Foreign Application Priority Data

Mar. 27, 1982 [JP] Japan ..... 57-48130

[51] Int. Cl.[3] ..... G03C 7/26

[52] U.S. Cl. ..... 430/543; 430/542; 430/545; 430/546; 430/631; 430/634; 430/635; 430/636; 430/637

[58] Field of Search ..... 430/543, 545, 546, 551, 430/614, 372, 631, 542, 634, 635, 636, 637

[56] References Cited

U.S. PATENT DOCUMENTS

| | | | |
|---|---|---|---|
| 2,870,015 | 1/1959 | Allen et al. | 430/614 |
| 3,862,955 | 1/1975 | Grivas | 544/322 |
| 4,224,403 | 9/1980 | Toda et al. | 430/614 |
| 4,336,324 | 6/1982 | Koboshi et al. | 430/372 |

*Primary Examiner*—J. Travis Brown

*Attorney, Agent, or Firm*—Frishauf, Holtz, Goodman & Woodward

[57] ABSTRACT

There is disclosed a light-sensitive silver halide photographic material comprising at least one hydrophilic colloid layer containing at least one compound represented by the following general formula [I]:

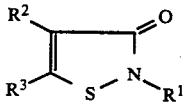

[I]

wherein $R^1$, $R^2$ and $R^3$ have the same meanings as defined in the specification.

The light-sensitive silver halide photographic material according to this invention has excellent bacteriocidal properties and does not adversely affect photographic performance.

23 Claims, No Drawings

LIGHT-SENSITIVE SILVER HALIDE PHOTOGRAPHIC MATERIAL

This invention relates to a light-sensitive silver halide photographic material, more particularly to an improved hydrophilic colloid used as a binder for the light-sensitive silver halide photographic material.

Generally, the light-sensitive silver halide photographic material can be prepared by coating a support with one or more light-sensitive emulsion layers and, where required, photography-constituting layers such as a subbing layer, an interlayer, a filter layer, an antihalation layer and a protective layer. Examples of the binders for these photography-constituting layers include gelatin and gelatin derivatives such as phenylcarbamylated gelatin, acylated gelatin and phthalated gelatin as mentioned in U.S. Pat. Nos. 2,614,928 and 2,525,753; and gelatins graft polymerized with monomers having polymerizable ethylene groups such as acrylic acid (acrylate), methacrylic acid (methacrylate) and acrylonitrile as mentioned in U.S. Pat. Nos. 2,548,520 and 2,831,767, colloidal albumin, agar, gum arabic, alginic acid, cellulose derivatives such as hydrolyzed cellulose acetate, carboxymethyl cellulose, hydroxyethyl cellulose and methyl cellulose; and synthetic binders, for example, polyvinyl alcohol, partially saponified polyvinyl acetate, polyacrylamide, poly-N,N-dimethylacrylamide and poly-N-vinylpyrrolidone; water-soluble polymers as mentioned in U.S. Pat. Nos. 3,847,620, 3,655,389, 3,341,332, 3,615,424 and 3,860,428; These binders can be employed in the form of a compatible mixture of two or more thereof in accordance with a desired use.

It is known that the hydrophilic colloid usable as the binder for the light-sensitive silver halide photographic material is easily affected by microorganisms such as bacteria, yeast, fungi and the like. Especially in the case that the support is coated with the hydrophilic colloid for photography, the influence of the microorganisms is noticeable, because the coating operation is carried out at a temperature suitable for their propagation. If the hydrophilic colloid rots or decomposes due to the presence of the microorganisms, a coating solution would drop in viscosity, or a coated layer would decrease in strength, or a uniform coating would not be obtained owing to comet-like faults which result from tiny agglomerates of the fungi or the like, or metabolite of the microorganisms would have adverse influence on the photography.

Further, when the light-sensitive photographic material is allowed to stand under high-temperature and high-humidity conditions, the fungi and the like will propagate thereon, with the result that the quality of the light-sensitive photographic material will be impaired to a substantial extent.

It is known that a bacteriocide or a fungicide may be added to the light-sensitive photographic material in order to prevent the hydrophilic colloid for the light-sensitive photographic material from suffering attack of the bacteria, yeast or fungi.

Examples of the antiseptic or fungicide for such a purpose generally include aromatic hydroxy compounds such as phenol, thymol, trichlorophenol, tetrachlorophenol, pentachlorophenol, cresol, p-chloro-m-cresol, o-phenylphenol, benzyl phenol, 2-benzyl-4-chlorophenol, chlorophene, dichlorophene, bromochlorophene, 2,2'-dihydroxy-5,5'-dichlorodiphenylmonosulfide, 2,4,4'-trichloro-2'-hydroxydiphenyl ether, 3,4,5-tribromosalicylanilide and 4-n-hexylresorcinol, or their salts; compounds each having a carbonyl group such as formaldehyde, paraformaldehyde, chloroacetaldehyde, glutaraldehyde, chloroacetamide and methylolchloroacetamide; carboxylic acids or their esters such as benzoic acid, monobromoacetic acid ester, p-hydroxybenzoic acid ester and sorbic acid; amines such as hexamethylenetetramine, alkyl guanidine and nitromethylbenzylethylenediamine; disulfides such as tetramethylthiuram disulfide; nitrogen-containing heterocyclic compounds such as 2-mercaptobenzothiazole, 2-(4-thiazolyl)-benzimidazole and 2-methoxycarbonylaminobenzimidazole; organic mercury compounds such as mercury phenylacetate, mercury phenylpropionate and mercury phenyloleate; and antibiotics such as neomycin, kanamycin, polymycin, streptomycin and flamycin. It is also known that some of the recited antiseptics and fungicides can be employed in photography. Among these compounds above, however, some are not effective unless a great amount thereof is added to the hydrophylic colloid, some are deleterious to organisms, some are of effectiveness only to limited bacteria, some are harmful to the photography, or some are less effective as a result of interaction with other photographic additives. For example, phenols such as phenol and thymol which are most often used cannot provide a sufficient rotproof effect, if not added as much as 2% by weight or more with respect to the hydrophilic colloid. In addition thereto, the phenol has a little rotproof and fungiproof effect to fungi and yeast, and what is worse, it is very deleterious to organisms, though having a rotproof efficacy to bacteria. Further, an aldehyde such as formalin, though efficacious to bacteria, is not so satisfactory to fungi and is dangerous for organisms. And such an aldehyde is liable to bring about photographic fog on the light-sensitive silver halide photographic material. Furthermore, a heterocyclic compound such as benzothiazole sometimes causes a photographically harmful function, e.g. a desensitizing function. An organic mercury compound is not efficacious to bacteria and deleterious to organisms, though satisfactory to fungi. An antibiotic such as neomycin or kanamycin is efficacious to bacteria but is inefficacious to fungi and yeast.

On the other hand, surface active agents may be used alone or combination as coating auxiliaries in order to provide uniform coating of the layers constituting the light-sensitive photographic material, but they may be employed at times for other purposes, e.g. emulsification, sensitization, improvement is quality of dots, antistatic, improvement in penetration for treating solutions, antifoam, prevention of adhesion and the like. As these surface active agents, there are known nonionic surface active agents such as saponin, alkylene oxide series, glycerin series and glycidal series; anionic surface active agents each including an acid radical such as a carboxylic acid, a sulfonic acid or phosphoric acid; amphoteric surface active agents such as amino acids and aminosulfonic acids; higher alkylamines; heterocyclic compounds such as pyridine; and quaternary ammonium salts. When a anti microbial activity agent such as a phenol, e.g. hexylresorcinol is added to the coating solution including the anionic surface active agent and the nonionic surface active agent among the above-mentioned surface active agents, there will occur an interaction between the anti microbial activity agent and the surface active agents. Therefore, acquisition of sufficient bacteriocidal efficacy requires addition of a great amount of the anti microbial activity agent.

Moreover, in order to achieve the uniform and prompt coating of the layers which constitute the light-sensitive photographic material, the support can be coated with two or more layers at one time or in a continuous manner, and in this case, a thickening agent may be added thereto for adjustment of a viscosity of each layer to a desired level. As such a thickening agent, there can be used a polymer including anionic groups such as carboxyl groups or sulfonic groups. For example, Japanese Patent Publication No. 3582/1960 discloses a method for increasing the viscosity of a solution by adding a compound of the following general formula to the solution including gelatin;

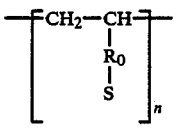

wherein $R_0$ represents an aliphatic or aromatic hydrocarbon residual group, or it may not exist so that S may combine directly with the straight chain of a vinyl polymerization; S represents a sulfonic group, its salt or derivative such as $-SO_3R_1$, $-SO_3X$ or $-SO_2NR_1R_2$;

wherein $R_1$ and $R_2$ each are a hydrogen atom, an alkyl group, an allyl group or an aralkyl group, and X represents ammonium or an alkali metal such as potassium or sodium.

Further, in "Photographic Science and Engineering", Vol. 14, p 178-183 (1970), there is disclosed the employment of an ammonium salt of the copolymer of maleic anhydride and methyl vinyl ether, sodium polystyrene sulfonate, ammonium polyvinyl phthalate or sodium dextron sulfate, as a thickening agent for gelatin and a gelatin derivative. Furthermore, in Japanese provisional patent publication No. 45830/1972, it is disclosed to incorporate, into a gelatin intermediate layer, a polymer and copolymer of acrylic acid, maleic acid or styrenesulfonic acid, or a cellulose derivative including an acid radical (e.g., carboxyl-methyl cellulose or cellulose sulfate).

When a bacteriocide such as a phenol is added to the coating solution including the anionic polymer, both of them will bring about an interaction mutually. Accordingly, a satisfactory efficacy cannot be obtained, unless a great deal of the bacteriocide is added thereto.

As seen from the foregoing, in a system where the anionic surface active agent or nonionic surface active agent is contained, or in a system where the anionic polymer is additionally contained besides either surface active agent, the interaction with the bacteriocide occurs, resulting in deterioration in the bacteriocidal efficacy, and it is accordingly required to make use of large amounts of the bacteriocide. However, when the bacteriocide is employed in such large amounts, physical properties of the coating solution will be adversely affected. For example, coagulation will occur in a used binder, and a finished light-sensitive photographic material will be made poor in photographic properties. Therefore, it is desirable that the amount of the bacteriocide to be added is as small as possible.

As is definite from the above, it is now demanded to develop an anti microbial activity agent for the photographic hydrophilic colloid which has a noticeable bacteriocidal efficacy to bacteria, yeast, fungi and the like in a small amount thereof.

A first object of this invention is thus to provide a light-sensitive silver halide photographic material including an anionic surface active agent and a nonionic surface active agent and further including a preferable anti microbial activity agent for a hydrophilic colloid thereof.

A second object of this invention is to provide an anti microbial activity agent for a hydrophilic colloid suitable for a light-sensitive photographic material including an anionic polymer.

A third object of this invention is to provide a light sensitive silver halide photographic material including an anti microbial activity agent, for a hydrophilic colloid, which does not exert a bad influence upon photographic performances (sensitivity, photographic fog, graininess, sharpness and the like).

A fourth object of this invention is to provide a light-sensitive silver halide photographic material which permits a uniform and easy coating.

As a result of a variety of researches, the inventors of this invention have found a compound which is represented by the following general formula [I] as an anti microbial activity agent and fungicide satisfying these objects above:

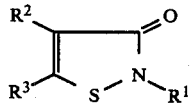

[I]

wherein $R^1$ represents a hydrogen atom, a straight-chain or a branched-chain alkyl group, a cyclic alkyl group, an alkenyl group, an aralkyl group, an aryl group, a heterocyclic group, an alkylamido group, an arylamido group, an alkylthioamido group, an arylthioamido group, an alkylsulfoamido group or an arylsulfoamido group; $R^2$ and $R^3$ each represent a hydrogen atom, a halogen atom, an alkyl group, a cyclic alkyl group, an aryl group, a heterocyclic group, a cyano group, an alkylthio group, an arylthio group, an alkylsulfoxide group or an alkylsulfonyl group; however, said alkyl group, cyclic alkyl group, alkenyl group, aralkyl group, aryl group and heterocyclic group may have substituents.

The alkyl group and alkenyl group each represented by $R^1$ in general formula [I] have 1 to 36 carbon atoms, preferably 1 to 18 carbon atoms. The cyclic alkyl group above has 3 to 12 carbon atoms, preferably 3 to 6 carbon atoms. The aforesaid alkyl group, alkenyl group, cyclic alkyl group, aralkyl group, aryl group and heterocyclic group each may have any substituent. Examples of such substituents include halogen atoms, nitro, cyano, thiocyano, aryl, alkoxy, aryloxy, carboxy, sulfoxy, alkylcarbonyl, arylcarbonyl, alkoxycarbonyl, aryloxycarbonyl, sulfo, acyloxy, sulfamoyl, carbamoyl, acylamino, diacylamine, ureido, thioureido urethane, thiourethane, sulfonamido, heterocyclic, arysulfonyloxy, alkylsulfonyloxy, arylsulfonyl, alkylsulfonyl, arylthio, alkylthio, alkylsufinyl, arylsufinyl, alkylamino, dialkylamino, anilino, N-alkylanilino, N-arylanilino, N-acylamino, hydroxy, mercapto groups and the like.

The alkyl group represented by $R^2$ and $R^3$ in general formula [I] has 1 to 18 carbon atoms, preferably 1 to 9 carbon atoms. Further, the cyclic alkyl group represented thereby has 3 to 12 carbon atoms, preferably 3 to 6 carbon atoms. These alkyl and cyclic alkyl groups as well as the aryl group may have substituents, which include halogen atoms, nitro, sulfo, aryl, hydroxy groups and the like.

Typical examples of the compounds (hereinafter referred to as the compounds of this invention) reresented by the aforesaid general formula [I] are as follows, but the compounds of this invention are not to be limited to these examples:

(EXEMPLARY COMPOUNDS)

2-(N-methylcarbamoyl)-3-isothiazolone, 5-methyl-2-(N-methylcarbamoyl)-3-isothiazolone, 2-(N-methylthiocarbamoyl)-3-isothiazolone, 4-bromo-5-methyl-2-(N-methylcarbamoyl)-3-isothiazolone, 4-cyano-5-methylthio-2-(N-methylcarbamoyl)-3-isothiazolone, 4-cyano-5-methylsulfinyl-2-(N-methylcarbamoyl)-3-isothiazolone, 4-cyano-5-methylsulfonyl-2-(N-methylcarbamoyl)-3-isothiazolone, 2-(N-n-butylcarbamoyl)-3-isothiazolone, 2-(N-t-octylcarbamoyl)-3-isothiazolone, 5-methyl-2-(N-phenylcarbamoyl)-3-isothiazolone, 4-cyano-5-methylthio-2-(N-phenylcarbamoyl)-3-isothiazolone, 4-bromo-5-methyl-2-(N-3-chlorophenylcarbamoyl)-3-isothiazolone, 5-bromomethyl-2-(N-3-chlorophenylcarbamoyl)-3-isothiazolone, 5-methyl-2-(N-3-chlorophenylcarbamoyl)-3-isothiazolone, 4-cyano-5-methylthio-2-(N-3-chlorophenylcarbamoyl)-3-isothiazolone, 2-(N-3-chlorophenylcarbamoyl)-3-isothiazolone, 5-methyl-2-(N-2-chlorophenylcarbamoyl)-3-isothiazolone, 5-bromomethyl-2-(N-2-chlorophenylcarbamoyl)-3-isothiazolone, 4-bromo-5-methyl-2-(N-3,4-dichlorophenylcarbamoyl)-3-isothiazolone, 5-methyl-2-(N-3,4-dichlorophenylcarbamoyl)-3-isothiazolone, 4-cyano-5-methylthio-2-(N-3,4-dichlorophenylcarbamoyl)-3-isothiazolone, 5-methyl-2-(N-4-tosylcarbamoyl)-3-isothiazolone, 4-cyano-5-methylthio-2-(N-4-tosylcarbamoyl)-3-isothiazolone, 4-bromo-5-methyl-2-(N-4-tosylcarbamoyl)-3-isothiazolone, 2-(N-n-propylcarbamoyl)-3-isothiazolone, 2-(N-ethylcarbamoyl)-3-isothiazolone, 2-(N-isopropylcarbamoyl)-3-isothiazolone, 4-bromo-2-(N-methylcarbamoyl)-3-isothiazolone, 2-(N-4-methoxyphenylcarbamoyl)-3-isothiazolone, 2-(N-2-methoxyphenylcarbamoyl)-3-isothiazolone, 2-(N-3-nitrophenylcarbamoyl)-3-isothiazolone, 2-(N-3,4-dichlorophenylcarbamoyl)-3-isothiazolone, 2-(N-n-dodecylcarbamoyl)-3-isothiazolone, 2-(N-2,5-dichlorophenylcarbamoyl)-3-isothiazolone, 2-(N-carboethoxymethylcarbamoyl)-3-isothiazolone, 2-(N-4-nitrophenylcarbamoyl)-3-isothiazolone, 5-methyl-2-(N-ethylcarbamoyl)-3-isothiazoione, 5-methyl-2-(N-ethylthiocarbamoyl)-3-isothiazolone, 5-chloro-2-(N-ethylcarbamoyl)-3-isothiazolone, 2-n-propyl-3-isothiazolone, 2-t-butyl-3-isothiazolone, 2-n-butyl-3-isothiazolone, 2-cyclohexyl-3-isothiazolone, 2-t-octyl-3-isothiazolone, 2-benzyloxy-3-isothiazolone, 5-chloro-2-methyl-3-isothiazolone, 5-chloro-2-benzyl-3-isothiazolone, 4,5-dichloro-2-methyl-3-isothiazolone, 2,4-dimethyl-3-isothiazolone, 4-methyl-2-(3,4-dichlorophenyl)-3-isothiazolone, 2-(3,4-dichlorophenyl)-3-isothiazolone, 4,5-dichloro-2-benzyl-3-isothiazolone, 4-bromo-5-chloro-2-methyl-3-isothiazolone, 4-bromo-2-methyl-3-isothiazolone, 2-hydroxymethyl-3-isothiazolone, 2-(β-diethylaminoethyl)-3-isothiazolone, 2-n-propyl-3-isothiazolone hydrochloride, 5-chloro-2-methyl-3-isothiazolone hydrochloride, 2-ethyl-3-isothiazolone hydrochloride, 2-methyl-3-isothiazolone hydrochloride, 2-benzyl-3-isothiazolone hydrochloride, 2-n-dodecyl-3-isothiazolone, 2-n-tetradecyl-3-isothiazolone, 2-(4-chlorobenzyl)-3-isothiazolone, 2-(2-chlorobenzyl)-3-isothiazolone, 2-(2,4-dichlorobenzyl)-3-isothiazolone, 2-(3,4-dichlorobenzyl)-3-isothiazolone, 2-(4-methoxybenzyl)-3-isothiazolone, 2-(4-methylbenzyl)-3-isothiazolone, 2-(2-ethoxyhexyl)-3-isothiazolone, 2-(2-phenylethyl)-3-isothiazolone, 2-(2-phenylethyl)-4-chloro-3-isothiazolone, 2-(1-phenylethyl)-3-isothiazolone, 2-n-decyl-3-isothiazolone, 2-n-octyl-3-isothiazolone, 2-t-octyl-4-chloro-3-isothiazolone, 2-t-octyl-4-bromo-3-isothiazolone, 2-n-nonyl-3-isothiazolone, 2-n-octyl-5-chloro-3-isothiazolone, 2-(4-nitrophenyl)-3-isothiazolone, 2-(4-carboethoxyphenyl)-3-isothiazolone, 5-chloro-2-methyl-3-isothazolone.monochloroacetate, 4,5-dichloro-2-methyl-3-isothiazolone.monochloroacetate, 2-ethyl-3-isothiazolone-monochloroacetate, 2-n-propyl-3-isothiazolone.monochloroacetate and 2-benzyl-3-isothiazolone monochloroacetate.

Synthetic methods of these exemplary compounds and their applications to other fields are mentioned in the specification of French Pat. No. 1,555,416, but this patent neither refers to nor implies any anti microbial activity agent for the hydrophilic colloid for use in the light-sensitive silver halide photographic material. The anti microbial activity agent for the hydrophilic colloid must have requirements of, (1) bringing about no interaction with photographic additives, (2) exhibiting a sufficient bacteriocidal and fungicidal action in a small amount, (3) having no influence on photographic performances such as sensitivity, photographic fog, graininess, sharpness and the like, (4) affecting adversely processing performances such as developability, desilvering and color restoration, (5) exerting no influence upon environmental ecosystem, and (6) not being harmful to humans. It is worthy of attention that the compounds of this invention can satisfy all of these requirements.

The layer including at least one of the compound of this invention and at least one of the anionic and nonionic surface active agents as well as, where required, the anionic polymer containing acid groups may be employed as any hydrophilic colloid layer, which constitues the light-sensitive silver halide material, such as a light-sensitive silver halide emulsion layer, a subbing layer, an intermediate layer, a filter layer, an antihalation layer or a protective layer.

The compound of this invention can be used in an amount of $1\times10^{-5}$ to 10% by weight, preferably $1\times10^{-5}$ to 1% by weight, most preferably $5\times10^{-5}$ to $3\times10^{-1}$% by weight, with respect to the hydrophilic colloid. Needless to say, the above range may vary toward smaller and larger amount sides with a kind of light-sensitive silver halide photographic material, additives to be added, a coating manner and the like.

The compound of this invention may be dissolved in a solvent, which does not exert a bad influence upon photographic performances, among water and organic solvents such as methanol, isopropanol, acetone and ethylene glycol. The resulting solution may be then added to the hydrophilic colloid, or be used to coat on the protective layer. Alternatively, the photographic material may be dipped into the bacteriocide solution in order to include the compound therein. Otherwise, the compound of this invention may be dissolved in a solvent having a high boiling point, a solvent having a low boiling point, or a mixed solvent thereof, and then be dispersively emulsified in the presence of the surface active agent to prepare an emulsion. Afterward, the thus prepared emulsion may be added to a solution including the hydrophilic colloid, or with the emulsion the surface of the protective layer may be coated.

The anionic surface active agent used in this invention means a surface active agent capable of dissociating into anions in water, and is a compound having an acid group such as a sulfonic acid, a sulfonic ester, a carboxylic acid, phosphoric acid or a phosphoric ester. Preferred examples of the anionic surface active agents for use in this invention include polyoxyethylene nonylphenyl ether sodium sulfate, polyoxyethylene diamylphenyl ether sodium sulfate, polyoxyethylene lauryl ether sodium sulfate, sodium di-2-ethylhexylsulfosuccinate, sodium lauryl phosphate and sodium lauroyl sacrosine, but it is to be noted that the anionic surface active agents regarding this invention are not limited to them.

The nonionic surface active agent used in this invention means a surface active agent, which does not ionize in water, and is a compound having a hydrophilic group such as an —OH group, a polyoxyethylene group or a combination of both. Preferred examples of the nonionic surface active agents used in this invention include a naturally occurring surface active agent such as saponin, and polyoxyethylene, polyoxyethylene nonylphenyl ether, polyoxyethylene diamylphenyl ether, polyoxyethylene lauryl ether and polyoxyethylene-polyglycidal block-copolymer, but it is to be noted that the nonionic surface active agent regarding this invention are not limited to them.

The anionic polymer including an acid group preferably used in this invention is a high polymeric compound having, on its side chain, at least one sulfonic group, carboxylic group or phosphoric group. Examples of such anionic polymers are polymers or copolymers of monomers such as styrenesulfonic acid, 2-acrylamido-2-methylpropanesulfonic acid, acrylic acid, methacrylic acid, maleic acid, a half ester of maleic acid, phosphoric acid monoester of hydroxyethyl acrylate and cellulose sulfate, which each have a group such as $$-SO_3M,\ -COOM \text{ or } -\overset{\overset{\displaystyle O}{\|}}{\underset{\underset{\displaystyle OM}{|}}{P}}-OM$$

(M represents a hydrogen atom or a cation) on a side chain. Among these high polymers, sodium polystyrenesulfonate, sodium polyacrylate, sodium cellulose sulfate and sodium dextran sulfate are particularly preferred.

Such high polymeric compounds each generally have a molecular weight of 50,000 to 1,000,000, preferably 100,000 to 500,000.

Reference to the light-sensitive silver halide photographic material according to this invention will further be made in detail as follows:

The silver halides employed for the light-sensitive photographic materials regarding this invention include any one for use in general silver halide photographic emulsions, such as silver chloride, silver bromide, silver iodide, silver chlorobromide, silver iodobromide, sliver chloroiodide and the like.

Crystals of these silver halides may be coarse or fine, and the crystal size distribution of them may be narrow or extensive. Further, the crystals of the silver halides may be in the state of normal crystals or twin, and a ratio of [100] face to [111] face is not limited. Furthermore, the crystal structure of these silver halides may be uniform from interior to exterior thereof, or be distinct in properties between interior and exterior thereof. Furthermore, these silver halides each may be of such a type as allows a latent image to be formed mainly on the surface thereof or such a type as allows it to be formed inside the crystal thereof. The silver halide crystals can be prepared in a known manner which is prevalently used in the art.

The silver halides which can be utilized advantageously in this invention may be prepared in a manner described in, for example, "The Theory of the Photographic Process", C. E. K. Mees and T. H. James, Macmillan, Vol. 3, chap. 2, p 31–43 (1966), Japanese patent publication Nos. 7772/1971, 18103/1971 or 1417/1976, U.S. Pat. No. 2,592,250, or U.K. Pat. No. 635,841.

In this invention, it is preferred to employ the silver halide emulsion in which soluble salts have been removed, but the emulsions still having them are also acceptable. Moreover, it is possible to use a combination of two or more silver halide emulsions which have been prepared separately.

The aforesaid silver halide emulsions can be sensitized with a chemical sensitizer. The chemical sensitizers used advantageously in this invention can be classified grossly into 4 groups, i.e. noble metal sensitizers, sulfur sensitizers, selenium sensitizers and reduction sensitizers.

As the noble metal sensitizers, there are known gold compounds as mentioned in U.S. Pat. Nos. 2,399,083, 2,540,085, 2,597,856, 2,597,915 and 2,642,361, and compounds of ruthenium, rhodium, palladium, iridium, platinum, as mentioned in U.S. Pat. Nos. 2,448,060, 2,540,086, 2,566,245, 2,566,263, 2,598,079 and 3,297,446. Particularly preferable compounds thereof include chloroauric acid, potassium chloroaurate, potassium aurithiocyanate, potassium chloroaurate, 2-aurosulfobenzothiazole methyl chloride, ammonium chloropalladate, potassium chloroplatinate, sodium chloropalladite and sodium chloroiridate. When the gold compound is selected, ammonium thiocyanate or sodium thiocyanate can be additionally used together with it.

As the sulfur sensitizers, there are known, in addition to active gelation, sulfur compounds as mentioned in U.S. Pat. Nos. 1,574,944, 1,623,499, 2,278,947, 2,410,689, 3,189,458 and 3,297,447. Particularly preferable compounds thereof include sodium thiosulfate, ammonium thiosulfate, thiourea, thioacetamide, allylillithiourea and N-allylrhodanine.

As the selenium sensitizers, there are known active and inactive selenium compounds as mentioned in U.S. Pat. Nos. 3,297,446, 3,442,653 and 3,297,447, and particularly preferable compounds thereof include colloid selenium, selenoacetophenone, selenoacetamide, selenourea, N,N-dimethylselenourea and triphenylphosphen selenide.

As the reduction sensitizers, there are known monovalent stannates as mentioned in U.S. Pat. No. 2,487,850, polyamines as mentioned in U.S. Pat. Nos. 2,518,698 and 2,521,925, bisalkylaminosulfides as in U.S. Pat. No. 2,521,926, silane compounds as in U.S. Pat. No. 2,694,637, iminoaminomethansulfinic acid as in U.S. Pat. No. 2,983,610, hydrazinium salts as in U.S. Pat. No.

3,201,254, and hydrazine derivatives as in U.S. Pat. Nos. 2,419,974 and 2,419,975.

Further, if desired, spectral sensitization and supersensitization may be given to the photographic emulsion by using a single or a combination of cyanine dyes such as cyanin, merocyanine and carbocyanine, alternatively using a combination of the just mentioned cyanine dye and a styryl dye or the like. Such color sensitization techniques have been adopted in the art since long before and are described in U.S. Pat. Nos. 2,688,545, 2,912,329, 3,397,060, 3,615,635 and 3,628,964, U.K. Pat. Nos. 1,195,302, 1,242,588 and 1,293,862, West German Pat. (OLS) Nos. 2,030,326 and 2,121,780, and Japanese patent publication Nos. 4936/1968 and 14030/1969. Selections of the aforementioned sensitizations and dyes can be determined optionally in accordance with wavelength range and sensitivity to be sensitized, as well as a purpose and use of the light-sensitive material.

In this invention, a stabilizer may be incorporated into the silver halide emulsion layer. Examples of the stabilizers useful for this invention include nitrogen-containing heterocyclic compounds such as tetrazaindene compounds, which are mentioned in U.S. Pat. Nos. 2,444,605, 2,444,606, 2,444,607, 2,444,608, 2,444,609, 2,716,062, 2,835,581 and 2,293,189, Belgian Pat. No. 773,459, Japanese patent publication Nos. 12124/1963, 376/1965, 13116/1968 and 26580/1969, and Japanese provisional patent publication No. 46733/1974.

When the light-sensitive silver halide mateial is utilized for color photography, the following couplers may be incorporated into the light-sensitive material.

As yellow couplers, open chain ketomethylene compounds have been prevalent since before, and in this invention there can be used benzoylacetoanilide type yellow couplers and pivaloylacetoanilide type yellow couplers which are now ordinary and popular. Further, it is also advantageous to employ two-equivalent type yellow couplers each in which a substituent capable of separating off at the time of a coupling reaction is substituted for the carbon atom at a coupling position.

Examples of these yellow couplers are mentioned in U.S. Pat. Nos. 2,875,057, 3,265,506, 3,664,841, 3,408,194, 3,447,928, 3,277,155 and 3,415,652, Japanese patent publication No. 13576/1974, and Japanese provisional patent publication Nos. 29432/1973, 66834/1973, 10736/1974, 122335/1974, 28834/1975 and 132926/1975.

Examples of the yellow couplers particularly effective in this invention are as follows:

α-(4-Carboxyphenoxy)-α-pivalyl-2-chloro-5-[γ-2,4-di-t-amylphenoxy)butyramido]acetoanilide.

α-Pivalyl-2-chloro-5-[γ-(2,4-di-t-amylphenoxy)-butyramido]-acetoanilide.

α-Benzoyl-2-chloro-5-[α-(dodecyloxycarbonyl)ethoxycarbonyl]acetoanilide.

α-(4-Carboxyphenoxy)-α-pivalyl-2-chloro-5-[α-(3-pentadecylphenoxy)butyramido]acetoanilide.

The magenta couplers usable in this invention are pyrazolone series, pyrazolotriazole series, pyrazolinobenzimidazole series and indazolone series compounds. As the pyrazolone series magenta couplers, compounds are advantageously usable which are disclosed in U.S. Pat. Nos. 2,600,788, 3,062,653, 3,127,269, 3,311,476, 3,419,391, 3,519,429, 3,558,318, 3,684,514 and 3,888,680 and Japanese Provisional patent publication Nos. 29636/1974, 111631/1974, 129538/1974 and 13041/1975; as the pyrazolotriazole series magenta couplers, compounds are usable which are disclosed in U.K. Pat. No. 1,247,493 and Belgian Pat. No. 792,525; as the pyrazolinobenzimidazole series magenta couplers, compounds are usable which are disclosed in U.S. Pat. No. 3,061,432, West German Pat. No. 2,156,111 and Japanese patent publication No. 60479/1971; and as the indazolone series magenta couplers, compounds are usuable which are disclosed in Belgian Pat. No. 769,116.

Examples of the magenta couplers particularly useful in this invention are as follows:

1-(2,4,6-Trichlorophenyl)-3-[3-(2,4-di-t-amylphenoxyacetamido)benzamido]-5-pyrazolone.

1-(2,4,6-Trichlorophenyl)-3-(3-dodecylsuccinimidobenzamido)-5-pyrazolone.

4,4'-Methylenbis-{1-(2,4,6-trichlorophenyl)-3-[3-(2,4-di-t-amylphenoxyacetamido)benzamido]-5-pyrazolone}.

1-(2,4,6-Tichlorophenyl)-3-(2-chloro-5-octadecylsuccinimidoanilino)-5-pyrazolone.

1-(2-Chloro-4,6-dimethylphenyl)-3-{3-[α-(3-pentadecylphenoxy)butyramido]benzamido}-5-pyrazolone.

1-(2,4,6-Trichlorophenyl)-3-(2-chloro-5-octadecylcarbamoylanilino)-5-pyrazolone.

3-Ethoxy-1-{5-[α-(3-pentadecylphenoxy)-butyramido]-phenyl}-5-pyrazolone.

1-(2,4,6-Trichlorophenyl)-3-(2-chloro-5-tetradecaneamidoanilino)-5-pyrazolone.

Cyan couplers used in this invention are generally phenols or naphthol derivatives. Examples of the cyan couplers are mentioned in U.S. Pat. Nos. 2,423,730, 2,474,293, 2,801,171, 2,895,826, 3,476,563, 3,737,316, 3,758,308 and 3,839,044, and Japanese provisional patent publication Nos. 37425/1972, 10135/1975, 25228/1975, 112038/1975, 117422/1975 and 130441/1975.

Typical examples of the cyan couplers useful in this invention are as follows:

1-Hydroxy-N-[δ-(2,4-di-t-amylphenoxy)butyl)butyl]-2-naphthoamide.

2,4-Dichloro-3-methyl-6-(2,4-di-t-amylphenoxyacetamido)phenol.

2,4-Dichloro-3-methyl-6-[α-(2,4-di-t-amylphenoxy)-butyramido]phenol.

1-Hydroxy-4-(3-nitrophenylsulfonamido)-N-[δ-(2,4-di-t-amylphenoxy)butyl]-2-naphthoamide.

1-Hydroxy-4-[(β-methoxyethyl)carbamoyl]methoxy-N-[δ-(2,4-di-t-amylphenoxy)butyl]-2-naphthoamide.

Hydroxy-4-(isopropylcarbamoyl)methoxy-N-dodecyl-2-naphthoamide.

2-Perfluorobutyramido-5-[α-(2,4-di-t-amylphenoxy)-hexanamido]phenol.

1-Hydroxy-4-(4-nitrophenylcarbamoyl)oxy-N-[δ-(2,4-di-t-amylphenoxy)butyl]-2-naphthoamide.

In this invention, colored magenta couplers and colored cyan couplers can also be used advantageously, in addition to the above-mentioned couplers.

For the purpose of improving sharpness and graininess of an image, the light-sensitive silver halide photographic material according to this invention may additionally contain a development inhibitor-releasing coupler (the so-called DIR coupler) or a development inhibitor-releasing material which does not form any dye at the reaction with the oxidant of a developing agent. These development inhibitor-releasing compounds may be used alone or in combination of two or more kinds thereof. Typical examples of the development inhibitor-releasing couplers are mentioned in U.K. Pat. No. 953,454, U.S. Pat. Nos. 3,148,062, 3,227,554, 3,701,783 and 3,733,201, and West German Pat. No. 1,800,420.

Further, typical examples of the development inhibitor-releasing materials are mentioned in U.S. Pat. Nos. 3,632,345 and 3,928,041, and Japanese provisional patent publication Nos. 77635/1974, 104630,1974, 36125/1975, 15273/1975 and 6724/1976.

For the adjustment of gradation, and the prevention of color turbidity and photographic fog, the so-called Weiss couplers may also be used which are disclosed in U.S. Pat. No. 2,998,314, U.K. Pat. No. 1,284,649 and West German Pat. No. 1,168,769.

The incorporation of the coupler and the DIR substance into the light-sensitive silver halide photographic material can be accomplished by applying any of a variety of known techniques which have been employed for the coupler since before.

For example, they may be incorporated thereinto by dissolving them in a solvent havig a high boiling point, as in U.S. Pat. No. 2,322,027. Further, the selected coupler and the solvent having a high boiling point may be dispersed separately in fine particles and are then mixed and used, as in U.S. Pat. No. 2,801,170, and in the latter case it is preferred to use a low-boiling or a water-soluble organic solvent. On this occasion, the DIR substance may be usd in the manner of being dispersively mixed with the coupler or of being dispersed and used separately from the coupler. When the low-boiling or water-soluble orgnic solvent is used, the used solvent may be removed from a dispersing solution in such a manner as in U.S. Pat. No. 2,801,170 or U.K. Pat. No. 1,367,686.

Alternatively, with regard to the coupler and DIR substance each having a water-soluble group, they can be used by the Fischer process, i.e. by dissolving them in an alkaline solution, or one of the coupler and DIR substance may be added in the dispersion manner and another of them may be added in the Fischer process to the same layer.

The high-boiling solvents applicable to this invention are high-boiling organic solvents which are immiscible with water, as mentioned in U.S. Pat. No. 3,322,027.

Examples of the particularly preferable organic solvents include dibutyl phthalate, dioctyl phthalate, diisodecyl phthalate, triphenyl phosphate, tricresyl phthalate, N,N-diethyldodecanamide, N,N-dibutyldodecanamide, benzyl phthalate, monophenyl-di-p-t-butylphenyl phosphate and di-methoxyethyl phthalate. Usable are also high-boiling solvents which are immiscible with water, as mentioned in U.S. Pat. No. 3,779,765, and Japanese provisional patent publication Nos. 90523/1974, 27921/1976 and 27922/1976.

Examples of the low-boiling or water-soluble organic solvents, which can be used together with or in place of the high-boiling solvents above, are disclosed in U.S. Pat. Nos. 2,801,171, 2,949,360 and elsewhere. Examples of the low-boiling organic solvents which are substantially insoluble in water include ethyl acetate, propyl acetate, butyl acetate, butanol, chloroform, carbon tetrachloride, nitromethane, nitroethane and benzene; examples of the water-soluble organic solvents include acetone, methyl isobutylketone, $\beta$-ethoxyethyl acetate, methoxyglycol acetate, methanol, ethanol, acetonitrile, dioxane, dimethylformamide, dimethylsulfoxide, hexamethylphosphoramide, diethyleneglycol monophenyl ether and phenoxyethanol. These solvents just mentioned can be employed alone or in combination of two or more kinds thereof.

As antifoggants for preventing the photographic fog which is often brought about by an unnecessary reaction between an oxidant yielded by the air oxidation of the developing agent and the coupler, hydroquinone series compounds are generally employed.

The typical hydroquinone series compounds include alkyl-substituted hydroquinones as mentioned in U.S. Pat. Nos. 2,336,327, 2,360,290, 2,403,721, 2,675,314, 2,701,197, 2,704,713, 2,728,659, 2,732,300 and 3,700,453, U.K. Pat. No. 891,158, and Japanese provisional patent publication No. 156438/1975; bis-hydroquinones as in U.S. Pat. No. 2,735,765; and polymeric compounds as in U.S. Pat. Nos. 2,710,810 and 2,816,028. They may be added to the light-sensitive materials alone or in combination of two or more kinds thereof.

In order to prevent abrasions on a film by reducing sliding friction thereof, a lubricant may be used on the back surface of the film or the uppermost layer of emulsion layers. Examples of useful lubricant materials include higher alkyl soda sulfates, higher fatty acids, higher alcohol esters, Carbowaxes, higher alkyl phosphoric esters and silicone compounds.

Particularly, the lubricant compounds disclosed in U.S. Pat. Nos. 2,882,157, 3,121,060 and 3,850,640 can be extremely effectively used alone or in combination thereof.

The light-sensitive silver halide photographic material according to this invention may contain an ultraviolet absorber in the constitutional layer thereof. Examples of the absorbers include benztriazoles, triazines and benzophenone compounds as disclosed in U.S. Pat. Nos. 3,004,896, 3,253,921, 3,533,794, 3,692,525, 3,705,815, 3,738,837 and 3,754,919, U.K. Pat. No. 1,321,355 and Japanese provisional patent publication No. 25337/1975, and acrylonitrile compounds as disclosed in U.S. Pat. Nos. 3,052,636 and 3,707,375. Particularly, it is preferred to use exclusively or combinedly Tinuvin PS, 320, 326, 327 and 328 which are manufactured by Ciba-Geigy AG.

The light-sensitive silver halide photographic material according to this invention can be prepared by coating the support with the emulsion, which support is excellent in flatness and causes little dimensional change during manufacture or photographic processing. As such a support, there can be used a plastic film, a plastic laminate paper, a baryta paper, a synthetic paper, and a rigid material such as a glass plate, a metal or a ceramic. Concrete examples of the supports include films of cellulose acetate, cellulose nitrate, polyvinyl acetal, polypropylene, polyethylene terephthalate, polyamide, polycarbonate and polystyrene; a polyethylene laminate paper; a polypropylene synthetic paper; and a baryta paper. These supports should be suitably selected in accordance with a use of the light-sensitive silver halide photographic material.

The support is generally subjected to a subbing treatment in order to build up the adhesion between it and a photographic emulsion layer. Typical examples of the subbing materials for use in the subbing treatment include copolymers of vinyl chloride or vinylidene chloride, copolymers of esters of vinyl alcohol, copolymers including unsaturated carboxylic acids, copolymers of dienes of butadiene and the like, copolymers of acetals, copolymers of unsaturated carboxylic anhydrides such as maleic anhydride, especially, copolymers of vinylalcohol esters such as vinyl acetate and styrene, and their compounds ring-cleaved by water, alkalis, alcohols or amines, cellulose derivatives such as nitrocellulose and diacetyl cellulose, compounds including epoxy groups, gelatin and modified gelatin and polyolefin copolymers, which are disclosed in Japanese patent publication Nos. 2597/1969, 12433/1972, 35458/1972, 35459/1972, 3564/1973, 9965/1973, 14185/1973 and 14434/1973, Japanese provisional patent publication Nos. 14274/1972, 37921/1972, 24723/1973, 89979/1973, 93672/1973, 3792/1974, 11118/1974, 18977/1974, 38616/1974, 99022/1974 and 3619/1976, U.S. Pat. Nos. 2,331,719, 2,779,684 and 2,943,937 and U.K. Pat. Nos. 1,134,211 and 1,136,902.

Further, in carrying out the subbing treatment, there may be used, together with the above-mentioned subbing material, gelatin or a polyol, a monovalent or polyvalent phenol, its halogenated derivative, a cross linking agent (hardner), a metallic oxide and the like, which are disclosed in Japanese patent publication Nos. 24270/1973 and 43122/1973, and Japanese provisional patent publication Nos. 592/1972, 23862/1973 and 26124/1973.

When the subbing treatment is actually carried out on the support, the subbing materials can be used alone or combinedly. The subbing treatment may also be given so as to form a subbing layer of a single layer or a laminated layers, or to form upper and lower subbing layers on both the sides of an intermediate layer in a laminated structure. As coating techniques, there are, for example, a manner of coating the support with the copolymer of vinylidene chloride and then gelatin thereon in the form of a laminated layer, and a manner of coating it with the copolymer of vinylidene chloride, then a mixture of the same and gelatin thereon and finally gelatin thereon. Such manners should be suitably selected in accordance with a use.

In addition to the aforesaid subbing treatment by the use of the subbing material, the adhesion between the support and the emulsion layer can be ensured also by a treatment such as corona discharge, glow discharge, another electronic bombardment, flame treatment, ultraviolet irradiation, oxidizing treatment, saponification treatment and surface-roughing. These treatments may be employed in a single or a combined manner, but can be carried out more effectively together with the coating of the above-mentioned subbing material. These treatments are mentioned in Japanese patent publication No. 3828/1970, Japanese provisional patent publication Nos. 19824/1972, 21744/1973, 85126/1973, 89731/1973, 13672/1973, 116302/1974 and 44818/1975, and U.S. Pat. Nos. 3,035,941 and 3,411,908.

The coating manner of the silver halide emulsion and other constitutional components for the light-sensitive silver halide photographic material can be selected from, for example, dip coating, double roll coating, air knife coating, extrusion coating and curtain coating. Further, a coating rate can be selected optionally, but a rate of 30 m/min or more is preferred.

With regard to such a material as a hardening agent that brings about gelation, prior to the coating operation, due to its prompt reactiveness when it previously is added to a coating solution, it is preferred to mix such a material therewith just before the coating process by the use of a static mixer or the like.

The light-sensitive silver halide photographic material according to this invention may be eligible for any of general black and white photography, X-rays, print, microfilm, electron-ray record, infrared-ray record, color photography and the like.

The light-sensitive silver halide photographic material according to this invention may be developed for a desired image after exposure in compliance with its use in a developing manner which is generally employed for the light-sensitive material for general black and white photography, roentgen, microfilm, lith film, photographic paper or color photography. Now, particularly, reference to the treatment of the light-sensitive color material will be made in detail as follows: the basic treatment steps of a negative-positive printing process include color development, bleach and fixation, and the basic treatment steps of a reversal process include development with a black and white negative developing solution, white exposure or processing with a bath containing a fogging agent, color development bleach, and then fixation. These steps in the processes may be done independently and separately, or may be done at one operation, using a processing solution having the respective mechanisms thereof, instead of the two or more processing steps. In the case of the one-operation process, for example, there is used a color treating monobath containing a color developing agent, a ferric salt bleaching agent and a thiosulfate fixing agent, or a bleach-fix monobath containing an (ethylenediaminetetraacetato)iron (III) complex bleaching agent and a thiosulfate fixing agent as disclosed in Japanese patent publication No. 1885/1960.

Limitations on the treating process of the light-sensitive color material are not particularly made, and any process is applicable. Typical examples of the treating processes include a process consisting of color development, bleach-fix, if necessary, washing and stabilization as described in U.S. Pat. No. 3,582,322; a process consisting of color development, separate bleach and fixation, if necessary, washing and stabilization as described in U.S. Pat. No. 910,002; a process consisting of prehardening, neutralization, color development, stop fixation, washing, bleach, fixation, washing, after-hardening and washing as described in U.S. Pat. No. 3,582,347; a process consisting of color development, washing, complementary color development, stopping bleach, fixation, washing and stabilization as described in Japanese provisional patent publication No. 54330/1975; a process consisting of prehardening, neutralization, washing, first development, stopping, washing, color development, stopping, washing, bleach, fixation and washing as described in U.S. Pat. No. 3,607,263; a process consisting of prehardening, neutralization, first development stopping, washing, color development, stopping, washing, bleach, organic acid bathing, fixation and washing as described in Japanese Provisional patent publication No. 36126/1975; a process consisting of first development, non-fixing silver dye bleach, washing, color development, pickling, washing, bleach, washing, fixation, washing, stabilizing and washing as described in Japanese provisional patent publication No. 81538/1975; a developing process consisting of halogenation bleach of the developed silver produced by color development, and then color development again to increase the quantity of a produced dye as described in U.S. Pat. Nos. 2,623,822 and 2,814,565; and a process for treating a light-sensitive material having less silver by use of an amplifier agent such as a peroxide or a cobalt complex as described in U.S. Pat. Nos. 3,674,990 and 3,761,265, West German Pat. (OLS) No. 2,056,360, Japanese provisional patent publication Nos.

6338/1972 and 10538/1972, West German Pat. (OLS) No. 2,226,770, and Japanese provisional patent publication Nos. 9728/1973 and 9729/1973. For prompt treatments, these steps may be carried out at a temperature of 30° C. or more. Alternatively, they may be otherwise carried out at room temperature or, in a special case, at 20° C. or less. Generally, they are advantageously conducted in the range of 20° to 70° C. Moreover, set temperatures in a series of the steps may be uniform or varied.

The typical color developing agents are p-phenyldiamine series compounds, and preferable examples thereof include 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, 3-β-methanesulfonamidoethyl-4-amino-N,N-diethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-diethylaniline, 4-amino-N,N-dimethylaniline, N-ethyl-N-β-[β-(β-methoxyethoxy)ethoxy]ethyl-3-methyl-4-aminoaniline and N-ethyl-N-β-(β-methoxyethoxy)ethyl-3-methyl-4-aminoaniline, and their salts such as sulfate, hydrochloride, sulfite and salts of p-toluenesulfonic acid. Further, compounds can be used which are mentioned in Japanese provisional patent publication Nos. 64932/1973 and 131526/1975 as well as Journal of American Chemical Society, Hent et al, Vol. 73, p 3100–3125 (1951).

Further, the color developing solution can be incorporated with a variety of additives, if desired. Main examples of the additives include an alkali agent, a pH adjuster or buffer, a development accelerator, an anti-foggant, a stain or sludge inhibitor, an intermediate layer effect accelerator and a preservative.

When the present invention is applied to the light-sensitive color material, a bleach treatment can be carried out in an ordinary manner after a color developing treatment. This bleach treatment may be conducted simultaneously with fixation or separately therefrom. A solution for the bleach treatment can serve as a bleach-fix bath, if a fixing agent is added thereto when needed.

As the bleaching agents, various compounds are usable in this invention, general and typical examples thereof include red prussiate, dichromates, iron (III) aminopolycarboxylic acids, metallic salts of aliphatic polycarboxylic acids, persulfates, copper complex salts, cobalt complex salts, iodine, bleaching powder and sulfamic acid, quinones, p-sulfophenylquinones and nitroso compounds, and their suitable combinations. Further, the bleaching bath or bleach-fix bath may contain not only a bleach accelerator but also a variety of additives.

In addition, the light-sensitive silver halide photographic material according to this invention can be applied to a variety of dye image forming processes, for example, color diffusion transfer processes. One of the processes comprises treating, with an alkaline developing solution including an aromatic primary amine color developing agent, the light-sensitive material having the silver halide emulsion layer retaining a nondiffusion coupler on the support, in order to leave a water-soluble or nondiffusible dye in the emulsion layer. Another of the aforementioned processes comprises treating, with an alkaline developing solution including an aromatic primary amine color developing agent, the light-sensitive material retaining the silver halide emulsion layer containing a nondiffusion coupler on the support, in order to be made soluble in an aqueous solvent and to thereby produce a diffusible dye, and transferring it to an image receiving layer composed of a hydrophilic colloid. This is called the diffusion transfer color system.

Furthermore, when the light-sensitive photographic material according to this invention is used for a light-sensitive color photographic material containing a less amount of silver halide which is described in West German Pat. (OLS) No. 2,357,964, more benefit of this invention can be obtained. In the case of the German Patent just mentioned, an amount of the silver halide in the photographic material is merely from a factor of several to a factor of a hundred as compared with the usual color light-sensitive material, for example, its amount is as small as about 65 to 375 mg/m$^2$ in a single layer of the material.

The development of the light-sensitive color photographic material having a less amount of the silver halide can be successfully and effectively carried out in accordance with, for example, a development process of subjecting a developed silver yielded by the color development to halogenation bleach, and doing the color development again to increase an amount of the produced dye, as described in U.S. Pat. Nos. 2,623,833 and 2,814,565; alternatively another development process of utilizing color intensification by the use of a peroxide as described in U.S. Pat. Nos. 3,674,490 and 3,761,265, West German Pat. (OLS) No. 2,056,360, and Japanese provisional patent publication Nos. 6338/1972 or 10538/1972, or by the use of a cobalt complex salt as described in West German Pat. (OLS) No. 2,226,770 and Japanese provisional patent publication No. 9728/1973.

This invention will be further described in detail in accordance with examples, as follows. However, it should be noted that these examples do not intend to restrict this invention.

EXAMPLE 1

To 100 ml of aqueous gelatin solutions each including 7 g of gelatin, the following surface active agents [A] and [B] were each added in an amount of 0.2 g. Then, phenol in an amount of 2% by weight as well as the following compounds [1], [2] and [3] of this invention in an amount of 0.2% by weight with respect to the solid gelatin were each added thereto as an anti microbial activity agent, in order to prepare samples (Nos. 1 to 15) set forth in Table 1 below. One strain of Acinetobacter genus was inoculated into each sample and was allowed to grow in a shake culture at 37° C. for 8 hours, and afterward each sample was inspected for the number of the cultivated bacteria. Obtained results are set forth in Table 1.

Surface active agent [A]

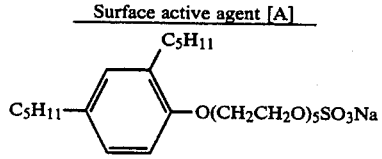

Surface active agent [B]

-continued

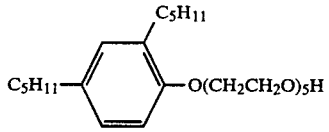

Compound [1]

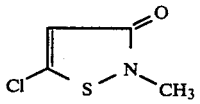

Compound [2]

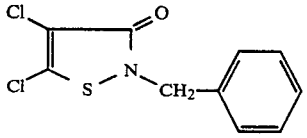

Compound [3]

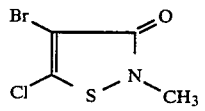

TABLE 1

| Sample No. | Surface active agent | Anti microbial activity agent | Bacteria number [number/ml] |
|---|---|---|---|
| 1 | Absent | Absent | $1.5 \times 10^7$ |
| 2 | " | Phenol | 0 |
| 3 | " | [1] | 0 |
| 4 | " | [2] | 0 |
| 5 | " | [3] | 0 |
| 6 | [A] | Absent | $1.6 \times 10^7$ |
| 7 | " | Phenol | $1.5 \times 10^6$ |
| 8 | " | [1] | 0 |
| 9 | " | [2] | 0 |
| 10 | " | [3] | 0 |
| 11 | [B] | Absent | $1.1 \times 10^7$ |
| 12 | " | Phenol | $8 \times 10^5$ |
| 13 | " | [1] | 0 |
| 14 | " | [2] | 0 |
| 15 | " | [3] | 0 |

As be definite from Table 1, the bacteriocidal effect of the phenol is noticeably poor when the surface active agents are added, but the compounds of this invention can maintain the bacteriocidal effect in spite of the presence of the surface active agents, what is better, they have 10 times or more as much the germicidal effect as phenol.

EXAMPLE 2

To 100 ml of high-sensitive X-ray silver iodide emulsions (which each contain 6% of gelatin) prepared in a usual manner, 0.2 g of the aforesaid surface active agents [A] and [B] each was added in order to prepare coating solutions. Then, to the prepared coating solutions, the following known Comparative compound [X] and compound [1] of this invention were each added in an amount of 5 mg. Polyethylene terephthalate supports were coated with a portion of each coating solution to prepare samples (Nos. 16 to 20) for sensitometry, and one strain of Pseudomonas genus was inoculated into each remaining coating solution and was allowed to grow in a shake culture at 37° C. for 8 hours, and afterward each example was inspected for the number of the cultivated bacteria.

Comparative compound [X]

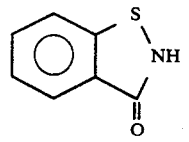

The sensitometry was carried out with KS-1 type sensitometer (manufactured by Konishiroku Photo Industry Co., Ltd.) in accordance with a series of steps consisting of exposure, development by the use of the following developing solution (at 40° C. for 30 seconds), fixation and washing in this order.

Composition of the developing solution

| | |
|---|---|
| Anhydrous sodium sulfite | 70 g |
| Hydroquinone | 10 g |
| Sodium carbonate (monohydrate) | 20 g |
| 1-Phenyl-3-pyrazolidone | 0.35 g |
| Potassium hydroxide | 5 g |
| 5-Methylbenzotriazole | 0.05 g |
| Potassium bromide | 5 g |
| Glutaraldehyde bisulfite | 15 g |
| Glacial acetic acid | 8 g |
| Make up to 1 liter with water | |

Results of the bacteria number and the sensitometry are set forth in Table 2 below.

TABLE 2

| Sample No. | 16 | 17 | 18 | 19 | 20 |
|---|---|---|---|---|---|
| Surface active agent | Absent | [A] | [B] | [A] | [B] |
| Anti microbial activity agent | Absent | [1] | [1] | [X] | [X] |
| Sensitivity* | 100 | 100 | 100 | 80 | 80 |
| Fog | 0.17 | 0.17 | 0.17 | 0.18 | 0.17 |
| Bacteria number [number/ml] | $1.6 \times 10^7$ | 0 | 0 | $8 \times 10^2$ | $3 \times 10^2$ |

*Note:
The sensitivity in this Table is represented with a relative sensitivity on the basis of taking the sensitivity of Sample 16 as 100.

As be apparent from Table 2, Comparative compound [X] is poor in sensitivity, but the compound of this invention exerts no influence on photographic performances and exhibits a good bacteriocidal effect. It is also understood that the compound of this invention exhibits a stronger bacteriocidal effect to the Pseudomonas genus than Comparative compound [X].

EXAMPLE 3

To 100 ml of one of lith type silver chlorobromide emulsions (which each contain 5% of gelatin) prepared by a usual manner, 4 mg of the above-mentioned compound [1] of this invention was added, and saponin was further added thereto as a nonionic active agent in order to prepare a coating solution. Subbed polyethylene terephthalate supports were coated with a portion of each prepared coating solution in an ordinary manner and were then dried to prepare samples (Nos. 20 and 21), which thereafter underwent sensitometry. On the other hand, one strain of Entrobacter genus was inoculated into each remaining coating solution and was allowed to grow in a shake culture at 37° C. for 8 hours, and bacteria number thereon was inspected. The sensitometry was carried out with KS-1 type sensitometer in accordance with a series of steps consisting exposure, development by the use of the following developing solution (at 27° C. for 1 minute and 40 seconds), fixation and washing in this order.

Composition of the developing solution

| | |
|---|---|
| Anhydrous sodium sulfite | 3 g |
| Formaldehyde-sodium sulfite addition product | 50 g |
| Boric acid | 7 g |
| Potassium bromide | 2.5 g |
| Anhydrous sodium carbonate (monohydrate) | 80 g |
| Hydroquinone | 20 g |
| Make up to 1 liter with water | |

The bacteria number, sensitivity and dot evaluation of the respective samples are set forth in Table 3 below. The graduation of the dot evaluation above was accomplished by taking a sharp dot having a small large fringe therearound as the 5 grade, taking a dot having a very fringe therearoun as the 1 grade, and classifying the intermediate range therebetween into the 4, 3 and 2 grades. Further, the sensitivity above was represented with a relative sensitivity on the basis of taking the sensitivity of Sample 20 as 100.

TABLE 3

| Sample No. | 20 | 21 |
|---|---|---|
| Anti microbial activity agent | Absent | [1] |
| Sensitivity | 100 | 100 |
| Dot | 5 | 5 |
| Bacteria number [number/ml] | $2 \times 10^6$ | 0 |

As be definite from the Table 3, the compound of this invention assumes a strong bacteriocidal effect without affecting photographic performances such as sensitivity and dot.

EXAMPLE 4

Triacetate film supports were coated with the following layers in turn in order to prepare samples (Nos. 22 to 27) of light-sensitive high-sensitivity multi-layer color negative materials:

Layer 1: Antihalation coating layer (1μ in thickness of the dried coating) containing a back colloid silver.

Layer 2: Intermediate gelatin layer (1μ in thickness of the dried layer) containing 2,5-di-tert-octylhydroquinone.

Layer 3: Red sensitive-emulsion layer, i.e. a red-sensitive silver iodobromide emulsion layer (which comprised a silver iodobromide emulsion containing 8 mole % of silver bromide and which had a dried layer thickness of 6μ) containing $6.8\times10^{-2}$ mole of 1-hydroxy-N-[γ-(2,4-di-tert-amylphenoxy)butyl]-2-naphthoamide as a cyan coupler, $1.7\times10^{-2}$ mole of 1-hydroxy-N-[δ-(2,4-di-tert-amylphenoxy)butyl]-4-(2-ethoxycarbonylphenylazo)-2-naphthoamide as a colored coupler, and $4\times10^{-3}$ mole of 2-(1-phenyl-5-tetrazolylthio)-4-(2,4-di-tert-amylphenoxyacetamide)-1-indanone as a development inhibitor-releasing material, per mole of the silver halide.

Layer 4: Intermediate layer which is the same as the Layer 2.

Layer 5: Low-sensitivity green-sensitive silver iodobromide emulsion layer (which comprised a silver iodobromide emulsion containing 8 mole % of silver iodide and which had a dried layer thickness of 3.5μ) containing $5.8\times10^{-2}$ mole of 1-(2,4,6-trichloro)phenyl-3-[3-(2,4-di-tert-amylphenoxy)acetamide]benzamido-5-pyrazolones as a magenta coupler, $1.7\times10^{-2}$ mole of 1-(2,4,6-trichlorophenyl)-3-[3-(octadecenylsuccinimido)-2-chloro]anilide-4-(γ-naphthylazo)-5-pyrazolones as a colored coupler, and $7\times10^{-3}$ mole of 2-(1-phenyl-5-tetrazolylthio)-4-(2,4-di-tert-amylphenoxyacetoamido)-1-indanone as a development inhibitor-releasing material, per mole of the silver halide.

Layer 6: High-sensitivity green-sensitive silver iodobromide emulsion layer (which comprised a silver iodobromide emulsion containing 6 mole % of silver iodide and which had a dried layer thickness of 2.5μ) containing the same magenta coupler, colored coupler, and development inhibitor-releasing material as in Layer 5 in amounts of $1.1\times10^{-2}$ mole, $5\times10^{-5}$ mole and $2\times10^{-3}$ mole, respectively, per mole of the silver halide.

Layer 7: Intermediate layer which is the same as the above Layer 2.

Layer 8: Yellow filter layer, i.e. a gelatin layer (1μ in thickness of the dried layer) containing a yellow colloid silver and 2,5-di-tert-octylhydroquinone.

Layer 9: Blue-sensitive emulsion layer, i.e. a blue-sensitive silver iodobromide emulsion layer (which was a silver iodobromide emulsion layer containing 7 mole % of silver iodide and which had a dried layer thickness of 7μ) containing $2.5\times10^{-1}$ mole of α-pivaloyl-α-(1-benzyl-2,4-dioxyimidazolidine-3-yl-2'-chloro-5-[γ-(2,4-di-tert-amylphenoxy)butyramido]-acetanilide as a yellow coupler, and $5\times10^{-3}$ mole of ω-bromo-ω-(1-phenyl-5-tetrazolylthio)-4-lauroylamidacetophenone as a development inhibitor-releasing material, per mole of the silver halide.

Layer 10: Protective layer which comprises a gelatin layer (1μ in thickness of the dried layer).

However, the above-mentioned Layers 5 and 6 were incorporated with the aforesaid surface active agent [A] as a surface active agent, sodium polystyrene sulfonate or sodium cellulose sulface as an anionic polymer and the aforesaid compound [1] of this inventin as an anti microbial activity agent in an amount of 4 mg with respect to 100 ml of the emulsion.

These samples (Nos. 22 to 27) were subjected to a wedge exposure through a green filter and then the following development. On the other hand, also for the samples which had been stored for 3 months under natural conditions (at 25° C. and a relative humidity of 60%) since coating, the same exposure and development as mentioned above were carried out.

| Development process (38 ° C.) | Processing time |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilization | 1 min. 30 sec. |

Compositions of the processing solutions used in the respective processing steps were as follows:

| [Composition of color developing solution] | |
|---|---|
| 4-Amino-3-methyl-N—ethyl- | 4.75 g |

-continued

| | |
|---|---|
| N—(β-hydroxyethyl)-aniline sulfate | |
| Anhydrous sodium sulfite | 4.25 g |
| Hydroxylamine.½ sulfate | 2.00 g |
| Anhydrous potassium carbonate | 37.50 g |
| Sodium bromide | 1.30 g |
| Nitrilotriacetic acid trisodium salt (monohydrate) | 2.50 g |
| Potassium hydroxide | 1.00 g |
| (make up to one liter with addition of water and adjust to pH 10.0) | |
| [Composition of bleaching solution] | |
| Ferric ammonium ethylenediamine-tetraacetate | 100.0 g |
| Diammonium ethylenediaminetetraacetate | 10.0 g |
| Ammonium bromide | 150.0 g |
| Glacial acetic acid | 10.0 ml |
| (make up to one liter with addition of water and adjust to pH 6.0) | |
| [Composition of fixing solution] | |
| Ammonium thiosulfate (50% aqueous solution) | 162 ml |
| Anhydrous sodium sulfite | 12.4 g |
| (make up to one liter with addition of water and adjust to pH 6.5) | |
| [Composition of stabilizing solution] | |
| Formalin (37% aqueous solution) | 5.0 ml |
| Konidax (trade name, produced by Konishiroku Photo Industry, Co., Ltd.) | 7.5 ml |
| (make up to one liter with addition of water) | |

Sensitometory was carried out with a green light for each developed sample.

Further, one strain of Acinetobacter genus was inoculated into each coating solution of the Layers 5 and 6 to which the anionic polymer and the bacteriocide were added, and allowed to grow in a shake culture at 37° C. for 8 hours, and afterward each sample was inspected for the number of the cultivated bacteria. The results of the sensitometry and bacteria number are set forth in Table 4 below. In this table, the sensitivity is prepresented with a relative sensitivity on the basis of taking the sensitivity of Sample 22 as 100.

TABLE 4

| | Sample No. | | | | | |
|---|---|---|---|---|---|---|
| | 22 | 23 | 24 | 25 | 26 | 27 |
| Anionic polymer | Sodium polystyrene sulfonate | | | Sodium cellulose sulfonate | | |
| Anti microbial activity agent | Absent | Phenol | [1] | Absent | Phenol | [1] |
| On same day | | | | | | |
| $D_{min}$ | 0.45 | 0.46 | 0.45 | 0.45 | 0.47 | 0.45 |
| Sensitivity | 100 | 100 | 100 | 100 | 100 | 100 |
| Natural storage | | | | | | |
| $D_{min}$ | 0.47 | 0.49 | 0.48 | 0.48 | 0.48 | 0.47 |
| Sensitivity | 100 | 100 | 100 | 100 | 100 | 100 |
| Bacteria number [number/ml] | $7 \times 10^7$ | $2 \times 10^5$ | 0 | $3 \times 10^8$ | $9 \times 10^5$ | 0 |

As be apparent from Table 4, the phenol and the compound of this invention both exert no influence on the photographic performances, but the latter has a stronger bacteriocidal effect than the former.

EXAMPLE 5

Both the surfaces of each of polyethylene terephthalate supports were coated with the following layers to prepare light-sensitive materials for X-rays:

Layer 1: Silver halide emulsion layer (a silver iodobromide gelatin emulsion).

Layer 2: Protective layer.

The components of the aforementioned Layer 1 were silver iodobromide having an average crystal size of 1.3μ and including 2.3 mole % of silver iodide, gelatin, saponin as a nonionic surface active agent, and styrene-maleic acid-acrylic acid copolyer as a thickening agent.

Further, the hydrophilic colloid components of the aforementioned Layer 2 were 5% of gelatin, surface active agent [A] of Example 1 as an anionic surface active agent, polymethyl methacrylate as a matt agent, polyoxyethylene dodecyl ether as an antistatic agent, and compound [1] or [2] of Example 1 as an anti microbial activity agent in an amount of 0.08% by weight with respect to the gelatin. One strain of Acinetobacter genus was inoculated into the hydrophilic colloid solution of the above Layer 2 and was allowed to grow in a shake culture at 37° C. for 16 hours, and afterward bacteria number and viscosity were measured for each sample. Results obtained are set forth in Table 5 below.

Next, formalin was added, as a hardening agent, to the Layer 2, and the supports were coated with the Layer 2 solution simultaneously with the Layer 1 solution in an extrusion coating manner. Its coating rate was 100 m/min.

For the obtained respective samples (Nos. 28 to 31), comet-like defects per 10 $m^2$ thereof were counted, and results are set forth in Table 5 below.

TABLE 5

| Sample No. | 28 | 29 | 30 | 31 |
|---|---|---|---|---|
| Anti microbial activity agent | Absent | Absent | [1] | [2] |
| Inoculation & Shake culture | Absent | Present | Present | Present |
| Bactria number [number/ml] | $2.5 \times 10^{-3}$ | $1.3 \times 10^{-7}$ | 0 | 0 |
| Viscosity [37° C., cps] | 9 | 7 | 9 | 9 |
| Comet number | 5 | 43 | 1 | 2 |

As be definite from Table 5, the compounds of this invention have a sufficient bacteriocidal effect even in the presence of the anionic surface active agent and nonionic surface active agent, and they lead to no drop of the viscosity of the coating solution and inhibit the comet-like defects.

EXAMPLE 6

Baryta papers which had been resin-coated with polyethylene were coated as Layer 1 with a blue-sensitive silver chloroiodobromide emulsion layer comprising 1 mole % of silver iodide and 19 mole % of silver chloride containing α-pivaloyl-α-(2,4-dioxo-1-benzylimidazolidine-3-yl)-2-chloro-5-[γ-(2,4-di-tert-amylphenoxy)butyramido]-acetanilide and anhydro-5-methyl-5'-methoxy-3,3'-disulfopropylselenacyanine hydroxide.

As Layer 2, a gelatin layer was provided thereon.

As Layer 3, a green-sensitive silver chlorobromide emulsion layer was provided thereon which comprised 20 mole % of silver chloride containing 1-(2,4,6-trichloro)phenyl-3-[3-(dodecylcarbamoyl)-2-chloro]-anilino-5-pyrazolone and anhydro-5,5'-diphenyl-3,3'-disulfopropyl-9-ethyloxacarbocyanine hydroxide.

As Layer 4, a gelatin layer was provided thereon which included 2,5-di-tert-octylhydroquinone as well as 2-(benzotriazole-2-yl)-4,6-di-tert-butylphenol and 2-(benzotriazole-2-yl)-4-tert-butylphenol as ultra violet absorbing agents.

As Layer 5, a red-sensitive silver chlorobromide emulsion layer was provided thereon which comprised 20 mole % of silver chloride containing 4,6-dichloro-5-methyl-2-[α-(2,4-di-tert-amylphenoxy)butyramido]-phenol and 3-ethylthia-1'-ethyl-4'-carbocyanine iodide.

As Layer 6, a protective layer comprising gelatin was provided thereon.

The respective emulsions used for the above-mentioned Layers 1, 3 and 5 were prepared as follows: the silver halide crystals were formed in the manner as disclosed in Japanese Patent Publication No. 7772/1971, and the formed crystals were subjected to a chemical sensitization by the use of soda thiosulfate (pentahydrate). Then, there were added thereto 4-hydroxy-6-methyl-1,3,3a,7-tetrazaindene as a stabilizer, bis(vinylsulfonylmethyl)ether as a hardening agent and the aforementioned surface active agent [A] as a surface active agent.

However, the aforementioned protective layers were incorporated with phenol and compound [1] of this invention, respectively.

Each sample having such six layers was sprayed with a spore dispersion of *Aspergillus niger*, and was allowed to stand at 28° C. and 95% RH for 14 days, and the growth state of bacteria was meanwhile observed.

Further, the sensitometry of each sample was carried out by wedge exposure through each filter of blue, green and red, and by the development of the following developing process:

| Development process (31° C.) | | |
|---|---|---|
| Color development | 3 min. 30 sec. | |
| Bleach-fix | 2 min. | |
| Washing | 2 min. | |
| Stabilization | 1 min. | |
| [Color developing solution] | | |
| Sodium metaborate | | 25 g |
| Sodium sulfite | | 2 g |
| Hydroxyamine sulfate | | 2 g |
| Potassium bromide | | 0.4 g |
| Potassium chloride | | 0.3 g |
| Caustic soda | | 4 g |
| Benzyl alcohol | | 15 ml |
| 4-(N—Ethyl-N—β-methansulfonamidoethyl)-amino-2-methylanilinesesqui sulfate | | 5 g |
| (make up to one liter with water and adjusted to pH 10.2) | | |
| [Bleach-fix solution] | | |
| Ferric salt of ethylenediamine-tetraacetic acid | | 45 g |
| Ammonium thiocyanate | | 10 g |
| Sodium sulfite | | 10 g |
| Ammonium thiosulfate (60% aqueous solution) | | 100 ml |
| Sodium ethylenediaminetetraacetate | | 5 g |
| (make up to one liter with water and adjust to pH 7.0) | | |
| [Stabilizing solution] | | |
| Tartaric acid | | 10 g |
| Sulfite | | 10 g |
| Sodium metaborate | | 20 g |
| (make up to 1 liter with water) | | |

The growth state of the bacteria and the results of the sensitometry are set forth in Table 6. With regard to the evaluation of the growth state of the bacteria, the state where myceliums and spores of the bacteria grow very well is taken as the 1 grade; the state where they grow slightly is taken as the 2 grade; and the state where they have no myceliums is taken as the 3 grade. Moreover, the sensitivity in the table is represented with a relative sensitivity on the basis of taking the sensitivity of Sample No. 32 as 100.

TABLE 6

| Sample No. | Anti microbial agent | Amount (% by weight to gelatin) | Sensitivity | Evaluation of bacteria state | Evaluation of bacteria growth |
|---|---|---|---|---|---|
| 32 | Absent | — | 100 | 1 | 1 |
| 33 | Phenol | 0.1 | 100 | 1 | 1 |
| 34 | " | 1 | 100 | 1 | 1 |
| 35 | " | 10 | 100 | 3 | 3 |
| 36 | Compound [1] | 0.01 | 100 | 3 | 3 |
| 37 | " | 0.1 | 100 | 3 | 3 |
| 38 | " | 1 | 100 | 3 | 3 |

The results in Table 6 indicate that the compound of this invention has no influence on the photographic performances and its bacteriocidal effect is 1000 times more than phenol.

We claim:

1. A light-sensitive silver halide photographic material, which comprises at least one hydrophilic colloid layer comprising at least one compound of formula:

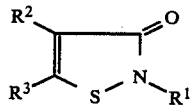

[I]

wherein $R^1$ is selected from the group consisting of a hydrogen atom, a straight-chain or a branched-chain alkyl group, a straight-chain or branched chain substituted alkyl group, a cyclic alkyl group, a substituted cyclic alkyl group, an alkenyl group, a substituted alkenyl group, an aralkyl group, a substituted aralkyl group, an aryl group, a substituted aryl group, an alkylcarbamoyl group, and an arylcarbamoyl group; $R^2$ and $R^3$ each are selected from the group consisting of a hydrogen atom, a halogen atom, an alkyl group, a substituted alkyl group, a cyclic alkyl group, a substituted cyclic alkyl group, an aryl group, a substituted aryl group, a cyano group, and an alkylsulfonyl group.

2. The light-sensitive silver halide photographic material according to claim 1, wherein said hydrophilic colloid layer further comprises a surface active agent.

3. The light-sensitive silver halide photographic material according to claim 2, wherein said surface active agent is an anionic surface active agent or a nonionic surface active agent.

4. The light-sensitive silver halide photographic material according to claim 3, wherein said anionic surface active agent is a compound having an $—SO_3M$ group, an $—OSO_3M$ group, a —COOM group, a $-\overset{\overset{\displaystyle O}{\|}}{P}-(OM)_n$ group or an $-O-\overset{\overset{\displaystyle O}{\|}}{P}-(OM)_n$ group, wherein M represents a hydrogen atom, an alkali metal atom, an ammonium group or an amino group, and n represents 1 or 2.

5. The light-sensitive silver halide photographic material according to claim 3, wherein said nonionic surface active agent is a compound having a polyoxyethylene group or an —OH group.

6. The light-sensitive silver halide photographic material according to claim 1, wherein said hydrophilic colloid layer further comprises a silver halide emulsion.

7. The light-sensitive silver halide photographic material according to claim 6, wherein said hydrophilic colloid layer further comprises a photographic coupler.

8. The light-sensitive silver halide photographic material according to claim 1, wherein said hydrophilic colloid layer further comprises an anionic polymer having an acid group.

9. The light-sensitive silver halide photographic material according to claim 8, wherein said acid group of the anionic polymer is $-SO_3M$, —COOM or $$-\overset{\overset{\displaystyle O}{\|}}{\underset{\underset{\displaystyle O}{\|}}{P}}-OM$$

wherein M represents a hydrogen atom or a cation.

10. The light-sensitive silver halide photographic material according to claim 9, wherein said anionic polymer is a homopolymer or a copolymer of monomers selected from the group consisting of a styrenesulfonic acid, 2-acrylamido-2-methylpropanesulfonic acid, acrylic acid, methacrylic acid, maleic acid, a half ester of maleic acid, phosphoric acid monoester of hydroxyethyl acrylate and cellulose sulfate.

11. The light-sensitive silver halide photographic material according to claim 9, wherein said anionic polymer is selected from the group consisting of sodium polystyrenesulfonate, sodium polyacrylate, sodium cellulose sulfate and sodium dextran sulfate.

12. The light-sensitive silver halide photographic material according to claim 1 wherein $R^1$ is an alkyl group or an alkenyl group each having 1 to 36 carbon atoms.

13. The light-sensitive silver halide photographic material according to claim 1, wherein the substituents for said substituted groups of $R^1$ are at least one substituent selected from the group consisting of halogen atoms, nitro, cyano, thiocyano, aryl, alkoxy, aryloxy, carboxy, sulfoxy, alkylcarbonyl, arylcarbonyl, alkoxycarbonyl, aryloxycarbonyl, sulfo, acyloxy, sulfamoyl, carbamoyl, acylamino, diacylamino, ureido, thioureido, urethane, thiorethane, sulfonamido, heterocyclic, arysulfonyloxy, alkylsulfonyloxy, arylsulfonyl, alkylsulfonyl, arylthio, alkylthio, alkylsufinyl, arylsufinyl, alkylamino, dialkylamino, anilino, N-alkylanilino, N-arylanilino, N-acylamino, hydroxy and mercapto groups.

14. The light-sensitive silver halide photographic material according to claim 1, wherein said compound of formula is present in an amount of $1\times10^{-5}$ to 10% by weight.

15. The light-sensitive silver halide photographic material according to claim 14, wherein said compound of formula is present in an amount of $1\times10^{-5}$ to 1% by weight.

16. The light-sensitive silver halide photographic material according to claim 15, wherein said compound of formula is present in an amount of $5\times10^{-5}$ to $3\times10^{-1}$% by weight.

17. The light-sensitive silver halide photographic material according to claim 1, wherein the alkyl group of said alkylcarbamoyl group contains from 1–12 carbon atoms.

18. The light-sensitive silver halide photographic material according to claim 1, wherein said arylcarbamoyl group is phenylcarbamoyl.

19. The light-sensitive silver halide photographic material according to claim 18, wherein the alkyl group of said alkylcarbamoyl group contains from 1–12 carbon atoms.

20. The light-sensitive silver halide photographic material according to claim 17, wherein said alkylcarbamoyl group is selected from the group consisting of methylcarbamoyl, n-butylcarbamoyl, t-octylcarbamoyl, n-propylcarbamoyl, isopropylcarbamoyl, ethylcarbamoyl, and dodecylcarbamoyl.

21. The light-sensitive silver halide photographic material according to claim 1, wherein said cyclic alkyl group has 3 to 12 carbon atoms.

22. The light-sensitive silver halide photographic material according to claim 1, wherein the substituents for the substituted groups of $R^2$ and $R^3$ are at least one substituent selected from the group consisting of halogen, nitro, sulfo, aryl and hydroxy.

23. The light-sensitive silver halide photographic material according to claim 1, wherein the alkyl group of $R^2$ and $R^3$ has from 1 to 18 carbon atoms.

* * * * *